US010413957B2

(12) United States Patent
Priem et al.

(10) Patent No.: US 10,413,957 B2
(45) Date of Patent: Sep. 17, 2019

(54) ELECTRO-HYDRAULIC FORMING MACHINE FOR THE PLASTIC DEFORMATION OF A PROJECTILE PART OF THE WALL OF A WORKPIECE TO BE FORMED

(71) Applicant: ECOLE CENTRALE DE NANTES, Nantes (FR)

(72) Inventors: Didier Priem, La Chapelle sur Erdre (FR); Guillaume Racineux, Chateau Thebaud (FR); Prabu Manoharan, Nantes (FR)

(73) Assignee: ECOLE CENTRALE DE NANTES, Nantes (FR)

( * ) Notice: Subject to any disclaimer, the term of this patent is extended or adjusted under 35 U.S.C. 154(b) by 798 days.

(21) Appl. No.: 14/909,382

(22) PCT Filed: Jul. 29, 2014

(86) PCT No.: PCT/FR2014/051964
§ 371 (c)(1),
(2) Date: Feb. 1, 2016

(87) PCT Pub. No.: WO2015/015114
PCT Pub. Date: Feb. 5, 2015

(65) Prior Publication Data

US 2016/0175912 A1 Jun. 23, 2016

(30) Foreign Application Priority Data

Aug. 1, 2013 (FR) ..... 13 57632

(51) Int. Cl.
*B21D 26/02* (2011.01)
*B21D 26/12* (2006.01)
(Continued)

(52) U.S. Cl.
CPC ..... *B21D 26/12* (2013.01); *B21D 26/045* (2013.01); *B21D 26/06* (2013.01); *B21D 26/08* (2013.01)

(58) Field of Classification Search
CPC ..... B21D 26/12; B21D 26/045; B21D 26/06; B21D 26/08
(Continued)

(56) References Cited

U.S. PATENT DOCUMENTS 3,222,902 A * 12/1965 Brejcha ..... B21D 26/12 29/421.2
3,338,080 A * 8/1967 Golden ..... B21C 37/0807 72/56
(Continued)

FOREIGN PATENT DOCUMENTS

EP 1488868 12/2004
JP S47-2959 1/1972
(Continued)

OTHER PUBLICATIONS

International Search Report PCT/FR2014/051964 dated Nov. 3, 2014.

*Primary Examiner* — David B Jones
(74) *Attorney, Agent, or Firm* — Young & Thompson

(57) ABSTRACT

An electro-hydraulic forming machine (1) for the plastic deformation of a projectile part (P13) of the wall (P1) of a workpiece (P) to be formed, preferably a cylindrical tubular workpiece, via a forming fluid (F), includes a tool (4) for applying the forming fluid on the inner face (P11) of the projectile part (P13), the application tool (4) including:—a chamber (44) intended to contain the forming fluid (F), cooperating with elements (3) for generating a shock wave in the forming fluid (F) intended to be contained in the chamber (44), and—at least one downstream port (42), intended to open opposite the projectile part (P13) of the
(Continued)

wall (P1) to be deformed and in fluid communication with the chamber (44), in order to allow the passage of the forming fluid and for propagating the generated shock wave towards the footprint (22) of a target support (2).

19 Claims, 3 Drawing Sheets

(51) Int. Cl.
*B21D 26/08* (2006.01)
*B21D 26/06* (2006.01)
*B21D 26/045* (2011.01)

(58) Field of Classification Search
USPC ..... 72/56
See application file for complete search history.

(56) References Cited

U.S. PATENT DOCUMENTS 3,561,239 A * 2/1971 Tominaga et al. ..... B21D 26/06 72/60
3,631,700 A * 1/1972 Kosaka ..... B21D 26/12 72/56
4,187,709 A * 2/1980 Legate ..... B21D 26/08 72/56
4,492,104 A * 1/1985 Weaver ..... B21D 26/08 29/421.2
4,557,128 A 12/1985 Costabile
6,305,204 B1 10/2001 Tauzer
8,713,982 B2 * 5/2014 Stranz ..... B21D 26/08 148/515
8,875,553 B2 * 11/2014 Zak ..... B21D 26/08 72/56
9,737,922 B2 * 8/2017 Zak ..... B21D 26/08
2004/0255463 A1 * 12/2004 Kiehl ..... B21D 26/033 29/897.2

FOREIGN PATENT DOCUMENTS

JP S59-127934 7/1984
JP H03-9234 1/1991

* cited by examiner

ELECTRO-HYDRAULIC FORMING MACHINE FOR THE PLASTIC DEFORMATION OF A PROJECTILE PART OF THE WALL OF A WORKPIECE TO BE FORMED

TECHNICAL FIELD THAT THE INVENTION RELATES TO

The present invention relates to machines for and methods of plastic deformation, advantageously at high velocity and at high pressure, of the wall of a workpiece by means of a technique of electro-hydraulic forming.

TECHNOLOGICAL BACKGROUND

Certain materials have a limited ductility. That is particularly the case with metals such as titan alloys or types of steel having a high limit of elasticity.

In this context, shaping of certain workpieces, especially tubular pieces, may be done by means of hydroforming machines, such as described in documents U.S. Pat. Nos. 6,305,204 4,557,128. In those machines, the fluid under pressure transits to the forming chamber through a channel having a small diameter provided in a cylindrical tool penetrating into the tube to be deformed.

Those hydroforming techniques ensure a progressive deformation of the material through obtaining provision of fluid under pressure by specific means.

But the deformation of the material obtained by such hydro-forming techniques generates an elastic return at the end of the process, which may appear limiting as far as applications are concerned.

In a very different field, which needs rather specific knowledge, forming of those materials may be done by high-velocity and high-pressure forming techniques, especially by electro-hydraulic forming techniques, or electro-hydroforming techniques, such as described in document EP-1 488 868.

Those electro-hydraulic forming techniques are based on the rapid movement of a forming fluid applied to one of the faces of the wall of the workpiece to be deformed, together with a rapid increase of the pressure of that fluid (contrarily to the progressive increase of pressure of hydroforming machines).

The forming fluid is then used as a means for stamping the piece to be deformed.

The energy that is necessary for the forming action is available as a shock wave in the forming fluid.

However, present electric hydroforming machines are not entirely adapted to apply certain deformations to specific structures of workpieces, especially an expansion to cylindrical tubular pieces having small diameters.

SUMMARY OF THE INVENTION

In this context, the present invention proposes a new electro-hydraulic forming machine, and a new method, appropriate for generating dynamic deformation of a projectile part of the wall of a workpiece to be formed, and especially adapted to the shaping of cylindrical tubular pieces having small diameters.

The corresponding electro-hydraulic forming machine is thus intended to allow for plastic deformation of a projectile part of the wall of a workpiece to be formed, preferably a cylindrical tubular piece, by a forming fluid intended for being applied on an internal face of that projectile part.

That electro-hydraulic forming machine comprises:

- a target support for receiving said projectile part of the workpiece to be deformed, said target support comprising an imprint intended to get in front of an external face of said projectile part, and
- means for generating a shock wave inside said forming fluid, advantageously for attaining a high velocity and a high pressure, adapted for causing the plastic deformation as wanted of said projectile part,
- and in accordance with the invention, said machine comprises a tool for applying said forming fluid on the internal face of the projectile part, said application tool comprising:
  - a chamber intended to contain said forming fluid, cooperating with said means for generating the shock wave, and
  - at least one downstream hole intended to end in front of the projectile part of the wall to be deformed and in fluid communication with said chamber for passing of said forming fluid and for propagation of the shock wave generated towards the imprint of the target support.

According to a particularly interesting embodiment, the application tool is shaped as a cylindrical tubular element which delimits the chamber intended to be filled with said forming fluid, and which comprises two ends:

- an upstream end cooperating with the means for generating a shock wave on said forming fluid, and
- a downstream end provided with several downstream holes for passing of said forming fluid and for the propagation of said generated shock wave.

In that case, preferably, the downstream holes of the application tool end radially through said application tool and are distributed over the circumference of its downstream end.

The downstream end of the application tool comprises a cylindrical external surface in which a groove is formed into which the downstream holes end, said groove being intended for forming a reserve of liquid in front of the imprint of the target support.

According to an advantageous feature, the application tool comprises, at the level of the downstream hole or holes, means for ensuring tightness to the forming-fluid, in order to limit the work zone of the latter. In this case, the tightness means comprises preferably

- seals provided on either side of the downstream hole or holes, adapted for getting in between said application tool and the workpiece to be deformed, or
- a flexible envelope covering, in a fluid-hermetic manner, the downstream hole or holes of the application tool.

According to a particularly interesting form of embodiment, the means for generating the shock wave comprises a piston adapted for ensuring a pressure multiplying effect, said piston being movable in translation/linear motion through an upstream hole of the application tool, in fluid communication with its chamber, said piston comprising two ends:

- a downstream end extending inside the chamber of the application tool, and
- an upstream end cooperating with the means for its operation in linear motion at high velocity. In this case, the means for the operation of the piston comprises advantageously an upstream space in which the upstream end of the piston extends, said space being adapted for receiving a conducting fluid and being provided with means for generating an electrical discharge into said conducting fluid, appropriate for generating a shock wave inside the latter. In an alternative manner, the means for the operation of the piston comprises a magnetic space at the level of which the upstream end of the piston extends, which end is provided with an electrically conducting piece appropriate for receiving magnetic forces intended to ensure the high-velocity acceleration of the piston.

According to still another particularity, the chamber of the application tool is further connected to means for generating a vacuum inside said chamber, and means for filling said chamber with said forming fluid.

The target support may be a matrix or a piece to be crimped on the workpiece to be deformed.

The present invention also relates to the tool for applying a shock wave to the forming fluid, for an electro-hydraulic forming machine as defined here-above.

The invention further relates to a method of plastic deformation of a projectile part of the wall of a workpiece by means of an electro-hydraulic forming machine as defined here-above, for example a cylindrical tubular piece for its expansion or for its shaping.

This method comprises the following steps:

- a step of positioning said workpiece to be deformed in the target support, for example a matrix perhaps comprising a piece to be crimped by expansion,
- a step of positioning the application tool in order to position its downstream hole or holes in front of the projectile part of the wall to be deformed and the imprint of the target support,
- a step of generating the shock wave in the forming fluid contained in the chamber of the application tool, and
- a step of extraction of the workpiece plastically deformed, with respect to said application tool.

DETAILED DESCRIPTION OF THE INVENTION

The invention will be further illustrated, without being limited at all, by the following description of different embodiments represented on the enclosed drawings wherein FIG. 1 is a schematic view, as a longitudinal cross-section, of the electro-hydraulic forming machine according to the invention before (upper half) and after (lower half) plastic deformation of the projectile part of the workpiece to be deformed;

Figure 3:
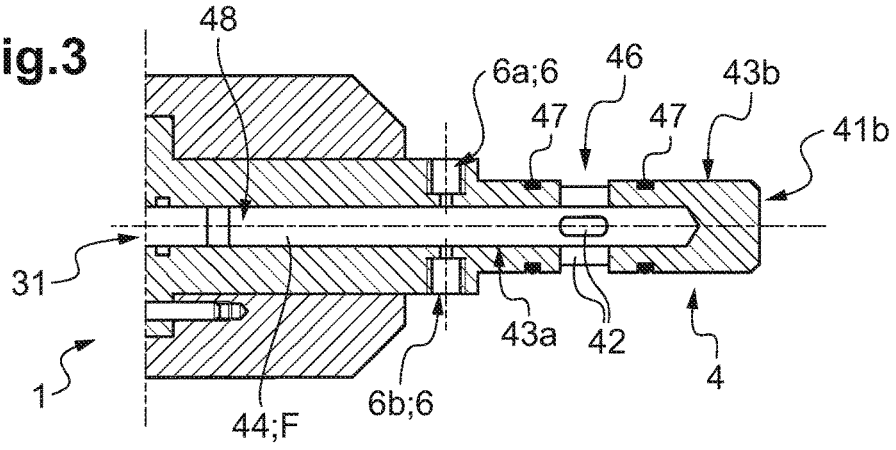
FIG. 3 is a partial and enlarged view of the machine shown on FIG. 2, showing its tool for applying the forming fluid on the internal face of the projectile part of the wall to be deformed.
Figure 6:
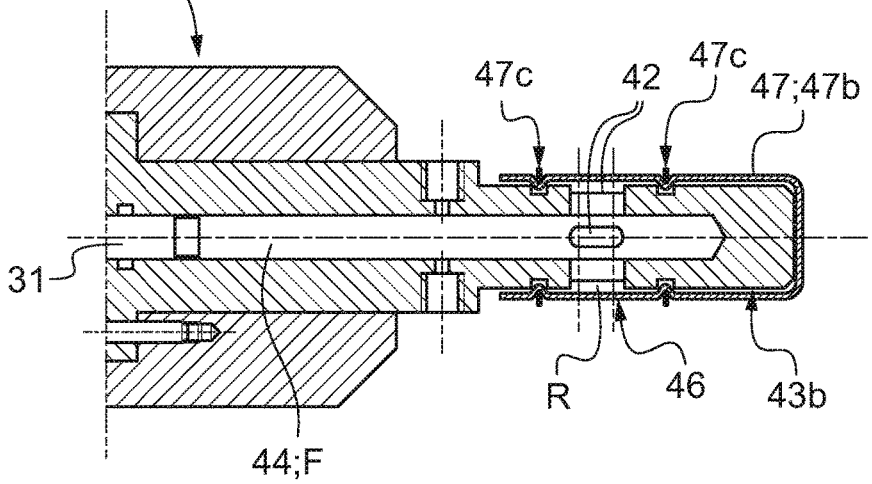
Figure 7:
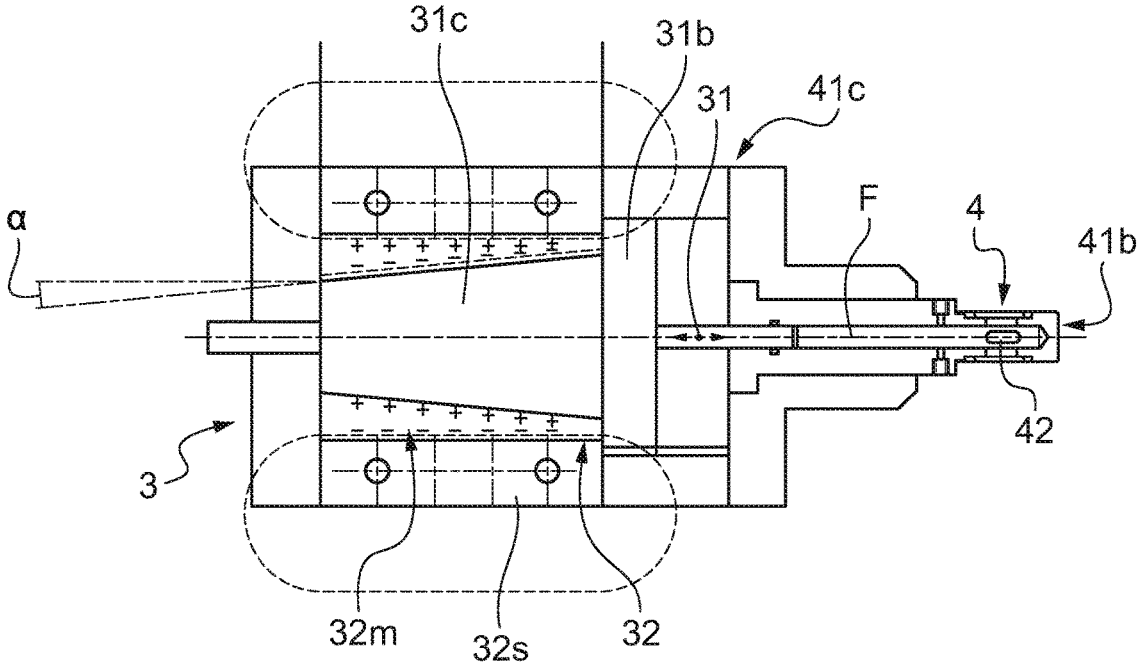

FIG. 6 still illustrates the application tool according to FIG. 3, in which the tightness means are replaced by an added flexible envelope;

FIG. 7 is a schematic view, as a cross-section, of another particular embodiment of the electro-hydraulic forming machine according to the invention, the means for the operation of the piston being of the "magnetic" type.

Figure 1:
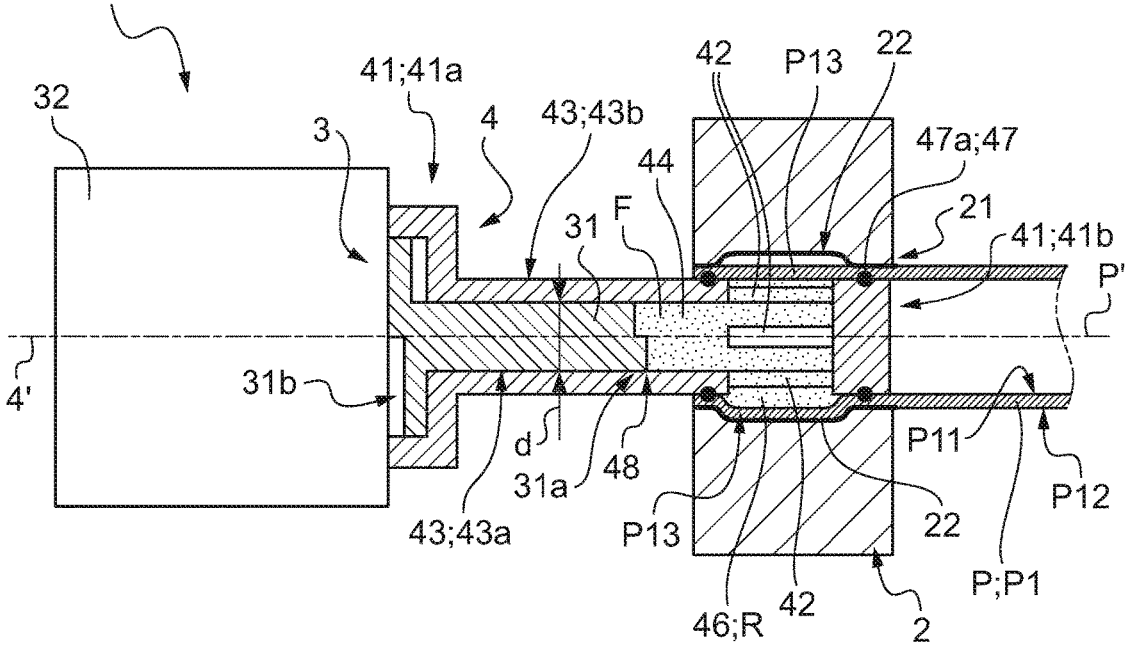

The electro-hydraulic forming machine 1, represented on FIG. 1 in a schematic manner and as a cross-section, is intended for allowing plastic deformation of a workpiece P by means of a forming fluid F.

In a general manner, the terms "deformation", "forming", "shaping" are employed in an equivalent manner.

That electro-hydraulic forming machine 1 allows for implementing methods of high-velocity forming which are able to push the limits of forming material and to limit their elastic return.

The workpiece P to be deformed is made of a material chosen amongst metallic materials (such as titan alloys, steels with high elasticity limit) or non-metallic, ductile or non-ductile materials.

The workpiece P advantageously consists of a cylindrical tubular piece having a longitudinal axis P' and comprising a wall P1 having an internal face P11 and an external face P12.

A "projectile" part P13 of the wall P1 of that workpiece P is intended to undergo a "plastic deformation", i.e. a permanent deformation obtained by displacing matter, especially of the stamping or drawing type.

That plastic deformation consists advantageously in a radial expansion or beading, called "dudgeonnage" in French, of the projectile part P13 of the workpiece P to be deformed.

Therefore, the forming fluid F is intended to be applied, with high velocity and with high pressure, on the internal face P11 of the projectile part P13 of the wall P1 to be deformed. Thus, what is implemented is to obtain pressing the projectile part P13 of that wall P1 at high velocity onto the imprint of a target support by means of high hydraulic pressure.

The forming fluid F consists advantageously of a liquid, preferably of water.

The intended "high velocity" is, without being limiting at all, between 100 and 150 m/s; and the indicated "high pressure" is, here again without being limiting at all, several hundreds of bars, or even higher than thousand bars.

To this end, according to the invention, the electro-hydraulic forming machine 1 comprises mainly:

- a target support 2 for receiving said projectile part P13 of the wall P1 to be deformed,
- means 3 for generating a shock wave inside said forming fluid F, the shock wave being adapted for causing the plastic deformation as wanted of said projectile part P13 of the wall P1 to be deformed, and
- a tool 4, also called a "nose", for applying said forming fluid F on the internal face P11 of the projectile part P13 of the wall P1 to be deformed.

As will be specified hereafter, the application tool 4 allows for local application of a shock wave on the projectile part P13, by means of the forming fluid F, advantageously for causing the radial expansion of an annular band which is part of the cylindrical tubular piece.

In a general manner, the "internal face" of the projectile part P13 is to be understood as the face onto which the forming fluid F is applied; and the "external face" of the projectile part P13 is to be understood as the opposite face which is intended to get pushed into the target imprint and to fit the latter.

The target support 2 advantageously consists of a matrix that may be intended to receive a piece to be expanded radially (or a piece to be crimped).

The target support 2 comprises a cylindrical through-hole 21 comprising an annular imprint 22 intended to get in front of the external face P12 of the projectile part P13 of the wall P1 to be deformed.

The diameter of that cylindrical through-hole 21 corresponds advantageously, within a clearance, to the external diameter of the workpiece P to be deformed, as defined by the external face P12 of its wall P1.

The profile of the imprint 22 is adapted accordingly, especially as a function of the final shape as wanted for the projectile part P13 of the wall P1 to be deformed.

The application tool 4 consists of a cylindrical tubular element having a longitudinal axis 4' intended to extend in a coaxial manner, or at least in an approximately coaxial manner, with respect to the longitudinal axis P' of the piece P to be deformed and with respect to the longitudinal axis of the cylindrical through-hole 21.

The application tool 4 comprises two ends 41:

an upstream end 41*a* which cooperates with the means 3 for generating the shock wave in the forming fluid F, and a downstream end 41*b* provided with several downstream holes 42 for passing of said forming fluid F and for the propagation of said generated shock wave in the latter.

The application tool 4 further comprises two cylindrical surfaces 43:

a cylindrical internal surface 43*a*, part of which delimits a chamber 44 intended to contain the forming fluid F, and a cylindrical external surface 43*b*, part of which is intended to get in front of the imprint 22 of the matrix 2 and of the internal face P11 of the wall P1 to be deformed.

The diameter of the cylindrical external face 43*b* of the application tool 4 corresponds advantageously, within a clearance, to the diameter of the internal face P11 of the wall P1 to be deformed.

The diameter of the cylindrical external face 43*b* is for example comprised between several millimeters (for example 2 through 20 mm) and several centimeters (for example 2 through 5 cm).

The downstream holes 42 of the application tool 4 are intended to end in front of the projectile part P13 of the wall P1 to be deformed and in front of the imprint 22 of the matrix 2.

The downstream holes 42 are adapted to allow for passing of the forming fluid F from said chamber 44, especially for ensuring optimal propagation of the shock wave generated in that forming fluid F towards the imprint 22 of the target support 2.

Therefore, the downstream holes 42 are open ended, i.e. on the one hand, they are in fluid communication with the chamber 44 at the inside and, on the other hand, open ended at the level of the peripheral external surface 43*b* of the application tool 4.

The downstream holes 42 are regularly distributed over the circumference of the application tool 4, and they are spaced at a constant angular sector. The downstream holes 42 are at least two; here, they are four, spaced two by two at an angular sector of about 90°.

Each downstream hole 42 extends radially, i.e. on a radial axis passing through the axis 4' of the application tool 4.

Further, the downstream holes 42 are each shaped as elongate slot with a longitudinal axis extending in parallel to the longitudinal axis 4' of the application tool 4.

The length of said holes 42, along the longitudinal axis 4', corresponds at least approximately to the width of the projectile part P13 along the longitudinal axis P' of the wall P1 or to the width of the imprint 22 of the target support 2.

The width of said holes 42 is adapted for occupying a maximum portion of the circumference of the downstream end 41*b* of the application tool 4, while maintaining a structure which is able to resist to the mechanical strain acting upon.

The external surface 43*b* of the application tool 4 further comprises, on the side of its downstream end 41*b*, a groove 46 into which the downstream holes 42 end.

That structure allows for a homogeneous distribution of the forming pressure over the whole internal circumference of the projectile part P13 to be deformed by radial expansion.

To this end, the groove 46 of generally annular shape extends over the whole circumference of the external surface 43*b* of the application tool 4 and ends into the periphery (at the opposite of its longitudinal axis 4').

The length of said groove 46 is equal to, or at least approximately equal to, the length of the downstream holes 42. The length of said groove 46, along the longitudinal axis 4', corresponds at least approximatively to the width of the projectile part P13 along the longitudinal P' of the wall P1 or to the width of the imprint 22 of the target support 2.

Its depth is some tenths of millimeters, for example comprised between 0.3 mm and 0.7 mm.

Said groove 46 is thus intended to form, together with the internal surface P11 of the projectile part P13 of the wall P1 to be deformed, a reserve of liquid R in front of the imprint 22 of the matrix 2.

The application tool 4 further comprises, at the level of its downstream holes 42, means 47 for ensuring tightness to the forming fluid F at its peripheral surface 43*b*.

Said tightness means 47 contribute to limit the work zone of the forming fluid F on either side of the downstream holes 42 and of the groove 46.

Here, said tightness means 47 comprises two O-rings 47*a* which are situated on either side of the downstream holes 42 and of the groove 46, around the external surface 43*b* of the application tool 4.

Said O-rings 47*a* are thus situated respectively upstream, as to the one, and downstream, as to the other, with respect to said downstream holes 42 and said groove 46.

Said O-rings 47*a* are adapted for getting in between the external surface 43*b* of the application tool 4 and the internal surface P11 of the wall P1 to be deformed, in order to participate in defining the upstream/downstream limits of the reserve of liquid R.

The chamber 44 of the application tool 4 extends over a downstream portion of the application tool 4, at the side of its downstream end 41*b*.

Said chamber 44 has a generally cylindrical shape with a diameter d defined by the internal surface 43*a* of the application tool 4.

For example, said chamber 44 has a diameter comprised between several millimeters and several centimeters and a volume sufficiently big for obtaining the deformation as wanted.

At the downstream end, the chamber 44 radially ends by the afore-mentioned downstream holes 42.

At an upstream end, said chamber 44 ends up by an upstream hole 48 located coaxially with respect to the longitudinal axis 4' of the application tool 4.

Said upstream hole 48 is in fluid communication with the chamber 44; it is connected to the means 3 for generating the shock wave in the forming fluid F contained in the chamber 44.

By "shock wave", one understands particularly, without being limited by any theory, a wave associated to an abrupt transition; it particularly has the shape of a high-pressure wave.

By "shock wave", one further understands a shock-type movement (moving, pressure or any other variable), associated to the propagation of the shock through the forming fluid F.

Said shock wave is advantageously characterized by a wave front in which the pressure increases abruptly up to a relatively important value.

Here, means 3 for generating the shock wave in the forming fluid F comprises a piston 31 which is movable in linear motion through the upstream hole 48 of the chamber 44, and this in a direction oriented coaxially to its longitudinal axis 4'.

The piston 31 extends over an upstream portion of the application tool 4, at the side of its upstream end 41*a*.

Said piston 31 is provided with two opposite ends:

- a downstream end 31*a* extending inside the chamber 44 of the application tool 4 and in contact with the forming fluid F, and
- an upstream end 31*b* cooperating with means 32 for its projection at high velocity in the direction upstream/downstream in order to generate the shock wave as wanted in the forming fluid F.

For example, the stroke of piston 31 is superior to the volume of liquid to be moved for allowing for the deformation; and its projection velocity is comprised between 100 and 150 m/s.

Said piston 31 is advantageously of the type of having a pressure multiplying effect.

By "pressure multiplying effect", one understands a pressure inside the chamber 44 of the application tool 4 which is equal to at least twice the pressure generated at the upstream end 31*b* of the piston 31.

By "pressure multiplying effect", one advantageously understands a multiple of the order of 5 through 15 (for example in the order of 10) between the pressure acting upon the upstream end 31*b* of the piston 31 and the pressure acting upon its downstream end 31*a*.

To this end, the downstream end 31*a* of the piston 31 has a front surface which is of the order of 5 through 15 (for example in the order of 10) times less than the front surface of the upstream end 31*b* of the piston 31. The cross-section relationship of the piston 31 allows performing multiplying of pressure.

For example, the diameter of the front surface of the downstream end 31*a* of the piston 31 is comprised between 10 mm and 20 mm and the diameter of the front surface of the upstream end 31*b* of the piston 31 is comprised between 50 and 70 mm.

The pressure is advantageously multiplied by a factor in the order of 5 through 15 (for example in the order of 10) from the upstream side to the downstream side.

Said piston thus applies a principle of "intensifying" the pressure of the fluid.

In the present case, the upstream end 31*b* of the piston 31 forms a head of a piston and its downstream end 31*a* forms a shaft extending inside the chamber 44.

The diameter of said downstream end 31*a* of the piston 31, forming a shaft, is advantageously identical, within a clearance, to the diameter of the chamber 44.

Practically, the workpiece P to be formed is lodged appropriately in the matrix 2 by positioning inside the through-hole 21.

Particularly, the projectile part P13 of its wall P1 is lodged appropriately, axially, in front of the imprint 22 of said matrix 2.

Then, the application tool 4 is introduced into said piece P, so that its downstream holes 42 is lodged in front of said same imprint 22 of the matrix 2.

To this end, the application tool 4 is introduced, the one coaxially with respect to the other, by linear motion through the free end of the workpiece P.

The tightness between the downstream end 41*b* of the application tool 4 and the wall P1 to be deformed is ensured by tightness means 47 which get in between said external surface 43*b* of the application tool 4 and the internal surface P11 of said wall P1.

Then, the application tool 4 is appropriately filled with the forming fluid F, in order that the latter entirely fills the chamber 44 by extending inside the downstream holes 42 and that it fills its groove 46 for forming the reserve of liquid R.

Then, the means 32 for the operation of linear motion of the piston 31 are actuated in order to cause its projection from a retracted upstream position (upper half of FIG. 1) to a deployed downstream position (lower half of FIG. 1).

The downstream end 31*a* of the piston 31 is thus moved at high velocity in the direction of the downstream holes 42 of the application tool 4, said movement generating a shock wave in the forming fluid F inside the chamber 44 of the application tool 4.

Said shock wave propagates in the forming fluid F up to the reserve of liquid R.

The forming fluid F thus applies a dynamic radial pressure to the internal face P11 of the projectile part P13 to be deformed, said application causing its radial expansion at high velocity until fitting the imprint 22 of the matrix 2 (cf. lower half of FIG. 1).

Once the deformation finished, the application tool 4 is withdrawn from the deformed workpiece P which is in turn withdrawn from the matrix 2.

For forming a new workpiece P, it is sufficient to set the piston 31 to its retracted upstream position (upper half of FIG. 1) and to re-perform the afore-mentioned operations.

Figure 2:
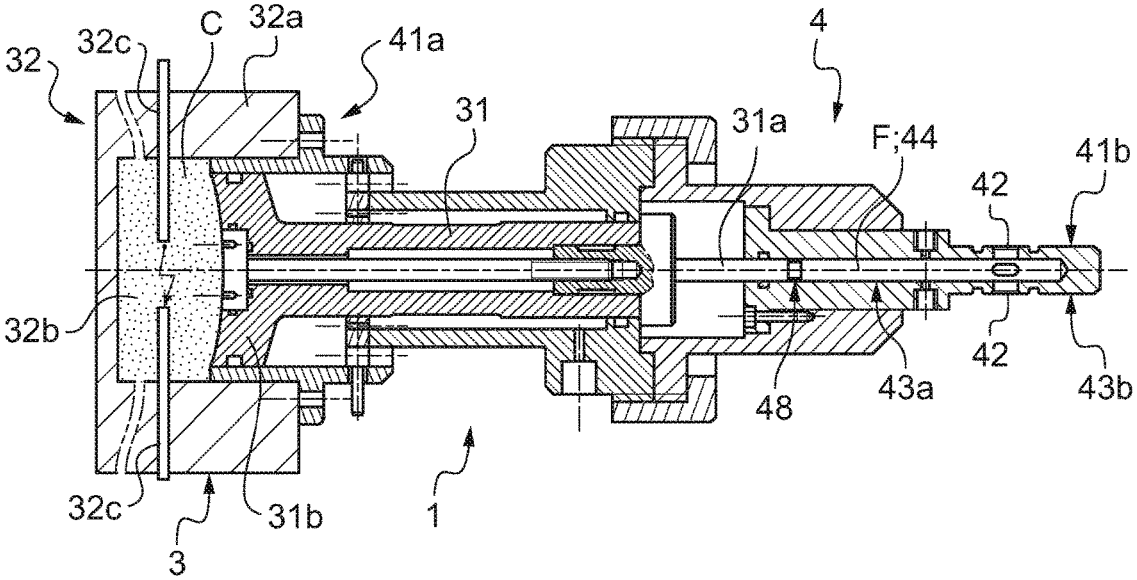
FIG. 2 is a schematic view, as a longitudinal cross-section, of a particular embodiment of the electro-hydraulic forming machine according to the invention, the means for the operation of the piston being of the "hydroelectric" type.

FIG. 2 and the following ones illustrate specific embodiments of the electro-hydraulic forming machine according to the invention.

The electro-hydraulic forming machine 1, illustrated by FIGS. 2 and 3, is of the type of those described here-above with reference to FIG. 1.

It comprises the target support (not shown), the means 3 for generating the shock wave in the forming fluid F, and the tool 4 for the application of the forming fluid F to the projectile part of the wall to be deformed (not shown).

Here again, the application tool 4 has the shape of a cylindrical elongate tubular element having two ends:

- the upstream end 41*a* which cooperates with the means 3 for generating the shock wave on the forming fluid F, and
- the downstream end 41*b* provided with several downstream holes 42, for passing of the forming fluid F and for the propagation of the shock wave generated in the latter.

Said application tool 4 further comprises said two cylindrical surfaces:

- the internal surface 43*a*, defining the chamber 44 intended to contain the forming fluid F, and
- the external surface 43*b*, intended to get in front of the imprint of the matrix and of the internal surface of the wall to be deformed.

The chamber 44 of the application tool 4 ends, downstream, by the downstream holes 42 extending at the bottom of the groove 46 intended to define a reserve of liquid R and, upstream, by an upstream hole 48 at the level of which the piston 31 extends.

Here, the chamber 44 of the application tool 4 is provided with two open ended conduits 6, an upper one 6*a* and a lower one 6*b* (FIG. 3).

Said two open-ended conduits 6*a*, 6*b* are situated coaxially to one another and perpendicularly and on either side of the longitudinal axis 4' of the application tool 4.

The open-ended upper conduit 6*a* is intended to be connected to the means for generating a primary air vacuum inside the chamber 44, i.e. for example between 1 and 1000 Pa. And the open-ended lower conduit 6*b* is intended to be connected to the means for filling and evacuating said chamber 44, with the forming fluid F.

The function of said means is to avoid generation of a mattress of compressible air in said chamber 44 during the generation of the shock wave by said dedicated means 3.

Means 3 for generating the shock wave comprises the piston 31, the means for operation 32 of which consists here in "hydroelectric" means for operation.

In a general manner, by "hydro-electric means for operation", one understands a device ensuring a projection of the piston by means of a propulsion force generated by a shock wave produced in a conducting fluid by an appropriate electric discharge.

Here, said means for operation 32 consists of a space 32*a* delimiting a chamber 32*b* inside which a pair of electrodes 32*c* and the upstream end 31*b* of the piston 31 extend.

Both electrodes 32*c* are intended for conducting the electric discharge inside a conducting fluid C filling the afore-mentioned chamber 32*b*.

Both electrodes 32*c* are lodged on either sides of the space 32*a*; they are spaced and situated in front of one another, and this, here, along a vertical or approximately vertical axis Said two electrodes 32*c* may be connected by a fusible conducting wire (not shown), in order to control the initiating time of the shock wave (especially as a function of its time to fuse).

The space 32*c* is advantageously provided with sucking and vacuum conduits (not shown) the function of which is to avoid generation of a mattress of compressible air during the electric discharge.

Here again, said piston 31 is adapted to ensure a pressure multiplying effect.

By "pressure multiplying effect", one advantageously understands a multiple of the order of 5 through 15 (for example in the order of 10) between the pressure acting by the conducting fluid C upon the upstream end 31*b* of the piston 31 and the pressure acting in the forming fluid F by its downstream end 31*a*.

Practically, for causing the motion of the piston 31, a strong electric discharge (several tenths of kV and kA) is set free in an extremely short time (between some microseconds and several hundreds of microseconds) between both electrodes 32*c*.

The strong electric current passes through the conductive liquid C situated inside the space 32*b*, generating a primary shock wave which dynamically raises the pressure of said conductive liquid C.

The generated primary shock wave produces a thrust onto the upstream end 31*b* of the piston 31 which is projected by linear motion towards the downstream side.

Said motion generates a final shock wave inside the forming fluid F of the chamber 44 of the application tool 4.

As explained further up, said final shock wave propagates in the forming fluid F up to the groove 46 for causing expansion of the workpiece P at high velocity, and this until it fits the imprint of the matrix (not shown here).

Figure 4:
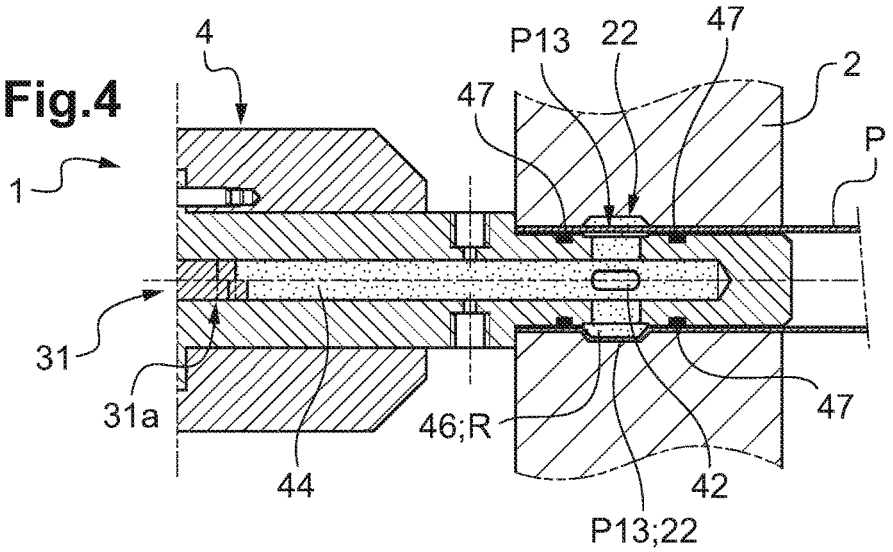
FIG. 4 illustrates a first embodiment of the application tool according to FIG. 3, for the expansion of the projectile part of a cylindrical tubular piece in a target support of the matrix type, and this before (upper half) and after (lower half) plastic deformation of said projectile part.

FIG. 4 illustrates an embodiment of the application tool 4 according to FIG. 3, for the expansion of the projectile part P13 of the workpiece P in a matrix 2.

In this case, said projectile part P13 gets pushed against the imprint 22 of said matrix 2 under the effect of the shock wave generated in the forming fluid F (as illustrated on the lower half of FIG. 4).

Figure 5:
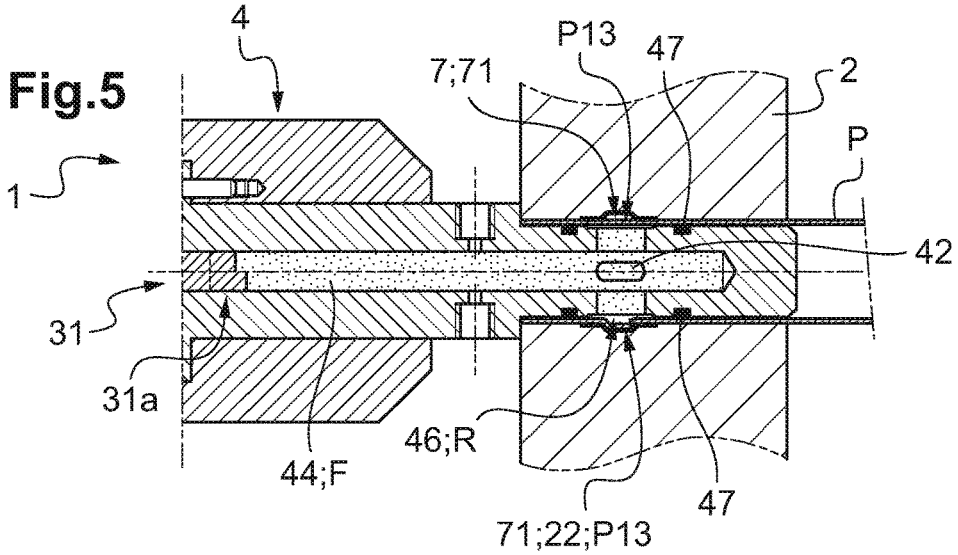
FIG. 5 illustrates a second embodiment of the application tool according to FIG. 3, for the expansion of the projectile part of a cylindrical tubular piece in a target support of the type of a piece to be crimped by expansion, and this before (upper half) and after (lower half) plastic deformation of said projectile part.

FIG. 5 illustrates the embodiment of the application tool 4 of FIG. 3 for the expansion of the projectile part P13 of the piece P in a ring 7 added by insertion.

The ring 7, forming here the target support, consists for example of a metallic piece, for example of the ferrule type. It is maintained in the imprint 22 of the matrix 2.

Said ring 7 comprises an internal surface 71 forming the imprint against which the projectile part P13 of the workpiece P is intended to fit when it is being shaped.

Practically, the projectile part P13 of the piece P to be formed gets pushed against the imprint 71 of the added ring 7, under the effect of the shock wave generated in the forming fluid F (such as illustrated on the lower half of FIG. 5).

Said ring 7 is thus sandwiched between the projectile part P13 of the workpiece P to be formed and the imprint 22 of the matrix 2. It is thus crimped on the workpiece P by radial expansion of its projectile part P13.

FIG. 6 illustrates the application tool 4 according to FIGS. 2 and 3, where its tightness means 47 consists of a flexible envelope 47*b*.

Here, the flexible envelope 47*b*, which is hermetic to fluids, consists of some type of sleeve made of a material such as polyurethane.

Said flexible envelope 47*b* covers a downstream portion of the external surface 43*b* of the application tool 4.

Especially, said flexible envelope 47*b* extends in front of the downstream holes 42 of the application tool 4, closing the peripheral opening of the groove 46 for radially delimiting the reserve R.

Said flexible envelope 47*b* is advantageously fixed to the application tool 4 by means of two collars 47*c* on either sides of the downstream holes 42 and the groove 46.

That embodiment is interesting as it delimits the reserve R and as it thus avoids any leakage of forming fluid F. Due to this, the operations of creating a vacuum and filling are not repeated at each forming operation.

Such a tool 4, together with said flexible envelope 47*b*, is implemented in a way which is identical to the one described further up with reference to FIGS. 1 through 5.

FIG. 7 still illustrates an electro-hydraulic forming machine 1 of the type of the one described here-above.

It comprises the target support (not shown), the means 3 for generating the shock wave inside the forming fluid F, and the tool 4 for applying forming fluid F to the projectile part of the wall to be deformed (not shown).

Means 3 for generating the shock wave comprises the piston 31, the means for operation 32 of which consists here in "magnetic" means for operation.

The "magnetic" means for operation 32 comprises a magnetic space 32*m* provided with a coil 32*s* with or without concentrating means for the magnetic field.

The upstream end 31*b* of the piston 31 is situated in the magnetic space 32*m*.

Here, said upstream end 31*b* comprises a piece 31*c*, which is electrically conductive, forming a propulsion device that is able to resist to magnetic thrust intended to ensure the high-velocity acceleration of the piston 31.

Here, the propulsion piece 31*c* constitutes a massive core which allows to adjust the angle of the concentrating means of the magnetic field, without changing the coil 32*s*.

Machining of the peripheral surface of the propulsion piece 31*c* allows to obtain a tapered piece diverging from the upstream side to the downstream side.

Said propulsion piece 31*c* has a defined angle α (with respect to the longitudinal axis of said propulsion piece 31*c*) which is intended to make move the piston 31.

The axial force as generated is a function of the angle α of the field-concentrating device.

The increase of that angle α allows for an increase of the propulsion thrust as generated on the propulsion device 31*c* and its associated piston 31.

Any other form of the "magnetic" means for the operation 32 is possible.

It is for example possible to use a coil without a field-concentrating device (for example with a tapered coil); then, the angle α is fixed and thus definite.

The coil also can consist of a flat coil machined in a spiral form, the axis of which extends at least approximatively coaxially to the axis of the piston; the piston in front of the coil directly receives the thrust generated by the discharge of the capacitors.

The present invention thus provides an interesting technical solution for the dynamic radial expansion of a workpiece, advantageously of a workpiece of tubular radial shape.

The high-velocity deformation of that piece allows to limit the elastic return, thus favoring its plastic deformation.

The machine according to the invention provides different advantages, especially:

- a possibility of crimping without polluting the workpiece P,
- an absence of elastic return,
- a very short time of shaping (several milliseconds),
- an application to all types of material,
- a possibility of automation,
- a possibility of radial expansion of tubular pieces having small diameters, for example between several millimeters and several centimeters.

The invention claimed is:

1. An electro-hydraulic forming machine for plastic deformation of a projectile part (P13) of a wall (P1) of a workpiece (P) by a forming fluid (F) being applied on an internal face (P11) of the projectile part (P13), said electro-hydraulic forming machine (1) comprising:

a target support (2, 7) that supports said projectile part (P13) of the workpiece (P), said target support (2, 7) comprising an imprint area (22, 71) that, with said projectile part supported in the target support, faces an external face (P12) of said projectile part (P13), means (3) for generating a shock wave inside said forming fluid (F) sufficient for causing the plastic deformation of said projectile part (P13), an application tool (4) for applying said forming fluid (F) having the generated shock wave on the internal face (P11) of the projectile part (P13), said application tool (4) comprising:

a chamber (44) that contains said forming fluid (F) having the generated shock wave, an upstream end (41*a*) with an upstream hole (48), the upstream end (41*a*) co-operating with the means (3) for generating a shock wave, and a downstream end (41*b*) with at least one downstream hole (42) directable towards a portion of the internal face (P11) of the projectile part (P13) located opposite the imprint area (22, 71) of the target support, the at least one downstream hole (42) being in fluid communication with said chamber (44), the at least one downstream hole (42) passing said forming fluid (F) having the generated shock wave towards the portion of the internal face (P11) of the projectile part (P13) located opposite the imprint area (22, 71) of the target support (2, 7), wherein the means (3) for generating the shock wave comprises a piston (31) that generates a pressure multiplying effect, and a means (32) for the operation of the piston (31) in linear motion to generate the shock wave inside the forming fluid (F), said piston (31) being movable in the linear motion through the upstream hole (48) of the application tool (4) and in fluid communication with the chamber (44) of the application tool (4), said piston (31) comprising i) a downstream end (31*a*) extending inside the chamber (44) of the application tool (4) and and in contact with the forming fluid (F) in the chamber (44), and ii) an upstream end (31*b*) that cooperates with the means (32) for operation of the piston in the linear motion, and wherein the means (32) for the operation of the piston in the linear motion comprises an upstream space (32*a*) in which the upstream end (31*b*) of the piston (31) extends, said upstream space (32*a*) containing a conducting fluid (C) and being provided with means (32*c*) for generating an electrical discharge into said conducting fluid (C) that generates a primary shock wave inside the conducting fluid (C) with a pressure that acts upon the upstream end (31*b*) of the piston (31), and via the downstream end (31*a*) of the piston (31) moving in the linear motion through the application tool (4), to generate a final shock wave inside the forming fluid (F) in the chamber (44).

2. The Electro-hydraulic forming machine according to claim 1, wherein the application tool (4) comprises a cylindrical tubular element which delimits the chamber (44), the cylindrical tubular element comprising the upstream end (41*a*) and the downstream end (41*b*) of the chamber (44).

3. The Electro-hydraulic forming machine according to claim 2, comprising plural of the at least one downstream hole (42), wherein the downstream holes (42) end radially through said application tool (4) and the downstream holes (42) are distributed over a circumference of the downstream end (41*b*) of the chamber (44).

4. The Electro-hydraulic forming machine according to claim 3, wherein the downstream end (41*b*) of the application tool (4) comprises a cylindrical external surface (43*b*) with a groove (46), the downstream holes (42) ending at the groove (46), said groove (46) providing a liquid reserve space in front of the imprint area (22, 71) of the target support (2, 7).

5. The Electro-hydraulic forming machine according to claim 1, wherein the application tool (4) comprises tightness means (47) for ensuring tightness to the forming fluid (F), the tightness means (47) is located at a level of the at least one downstream hole (42) and limits a work zone of the forming fluid.

6. The Electro-hydraulic forming machine according to claim 5, wherein the tightness means (47) comprises seals (47*a*) provided on either side of each of the at least one downstream hole (42), and with said projectile part supported in the target support, said seals being located between said application tool (4) and the workpiece (P).

7. The Electro-hydraulic forming machine according to claim 1, wherein the chamber (44) of the application tool (4) is further connected to:

means for generating a vacuum inside said chamber (44), and means for filling said chamber (44) with said forming fluid (F).

8. The Electro-hydraulic forming machine according to claim 2, wherein the application tool (4) comprises tightness means (47) for ensuring tightness to the forming fluid (F), the tightness means (47) is located at a level of the at least one downstream hole (42) and limits a work zone of the forming fluid.

9. The Electro-hydraulic forming machine according to claim 3, wherein the application tool (4) comprises tightness means (47) for ensuring tightness to the forming fluid (F), the tightness means (47) is located at a level of the at least one downstream hole (42) and limits a work zone of the forming fluid.

10. The Electro-hydraulic forming machine according to claim 4, wherein the application tool (4) comprises tightness means (47) for ensuring tightness to the forming fluid (F), the tightness means (47) is located at a level of the at least one downstream hole (42) and limits a work zone of the forming fluid.

11. The Electro-hydraulic forming machine according to claim 8, wherein the tightness means (47) comprises seals (47*a*) provided on either side of the downstream hole or holes (42), adapted for getting in between said application tool (4) and the workpiece (P) to be deformed, or a flexible envelope (47*b*) covering, in a fluid-hermetic manner, the downstream hole or holes (42) of the application tool (4).

12. The Electro-hydraulic forming machine according to claim 9, wherein the tightness means (47) comprises seals (47*a*) provided on either side of the downstream hole or holes (42), adapted for getting in between said application tool (4) and the workpiece (P) to be deformed, or a flexible envelope (47*b*) covering, in a fluid-hermetic manner, the downstream hole or holes (42) of the application tool (4).

13. The Electro-hydraulic forming machine according to claim 10, wherein the tightness means (47) comprises seals (47*a*) provided on either side of the downstream hole or holes (42), adapted for getting in between said application tool (4) and the workpiece (P) to be deformed, or a flexible envelope (47*b*) covering, in a fluid-hermetic manner, the downstream hole or holes (42) of the application tool (4).

14. The electro-hydraulic forming machine according to claim 5, wherein the tightness means (47) comprises a flexible envelope (47*b*) covering, in a fluid-hermetic manner, the at least one downstream hole (42) of the application tool (4).

15. The electro-hydraulic forming machine according to claim 1, wherein the conducting fluid (C) is electrically conductive and the forming fluid (F) is water.

16. The Electro-hydraulic forming machine according to claim 1, wherein the application tool (4) further comprises:

a seal (47*a*) located on each side of each of the at least one downstream hole (42), wherein, with said projectile part being supported in the target support, each said seal is being between said application tool (4) and the workpiece (P) to thereby provide sealing that limits a work zone of the forming fluid exiting the at least one downstream hole (42).

17. A method of plastic deformation of a projectile part (P13) of the wall (P1) of a cylindrical tubular workpiece (P) by means of an electro-hydraulic forming machine (1) according to claim 1, said method comprising the following steps:

a step of positioning said cylindrical tubular workpiece (P) in the target support (2, 7), a step of positioning the application tool (4) with the at least one downstream hole (42) in front of the projectile part (P13) of the wall (P1) and the imprint area (22, 71) of the target support (2, 7), a step of generating the final shock wave in the forming fluid (F) contained in the chamber (44) of the application tool (4), wherein a strong electric current passes through the conductive liquid (C) situated inside the upstream space (32*b*), generating the primary shock wave which dynamically raises the pressure of said conductive liquid (C), wherein the generated primary shock wave produces a thrust onto the upstream end (31*b*) of the piston (31) to project the piston (31) by linear motion towards the downstream end (41*b*) of the chamber (44), wherein said linear motion generates the final shock wave inside the forming fluid (F) inside the chamber (44) of the application tool (4), and the at least one downstream hole (42) passes said forming fluid (F) having the generated final shock wave towards the portion of the internal face (P11) of the projectile part (P13) located opposite the imprint area (22, 71) of the target support (2, 7) to thereby plastically deform the projectile part (P13) of the a wall (P1) of a workpiece (P), and a step of extraction of the workpiece (P) plastically deformed, with respect to said application tool (4).

18. The method plastic deformation of a projectile part (P13) of a wall (P1) of a workpiece (P) by a forming fluid (F) of an electro-hydraulic forming machine being applied on an internal face (P11) of the projectile part (P13), said method comprising the steps of:

supporting the said projectile part (P13) of the workpiece (P) of the electro-hydraulic forming machine, in a target support (2, 7), said target support comprising an imprint area (22, 71) that, with said projectile part supported in the target support, faces an external face (P12) of said projectile part (P13);

using a shock-wave generator (3) of the electro-hydraulic forming machine, generating a final shock wave inside said forming fluid (F) sufficient for causing the plastic deformation of said projectile part (P13); and using an application tool (4) of the electro-hydraulic forming machine, applying said forming fluid (F) on the internal face (P11) of the projectile part (P13) to deform a portion of the internal face (P11) of the projectile part (P13) located opposite the imprint area (22, 71) of the target support, said application tool (4) comprising:

i) a chamber (44) that contains said forming fluid (F), ii) an upstream end (41*a*) with an upstream hole (48), the upstream end (41*a*) co-operating with the shock-wave generator (3) for generating a primary shock wave, and iii) a downstream end (41*b*) with a downstream hole (42) directable towards the portion of the internal face (P11)

of the projectile part (P13) located opposite the imprint area (22, 71) of the target support, the downstream hole (42) being in fluid communication with said chamber (44), the downstream hole (42) passing said forming fluid (F) towards the portion of the internal face (P11) of the projectile part (P13) located opposite the imprint area (22, 71) of the target support to thereby deform the portion of the internal face (P11) of the projectile part (P13) located opposite the imprint area (22, 71) of the target support, wherein the shock-wave generator (3) comprises a piston (31) that generates a pressure multiplying effect, and a means (32) for the operation of the piston (31) in linear motion to generate the final shock wave inside the forming fluid (F), said piston (31) being movable in the linear motion through the upstream hole (48) of the application tool (4) and in fluid communication with the chamber (44) of the application tool (4), said piston (31) comprising i) a downstream end (31*a*) extending inside the chamber (44) of the application tool (4) and in contact with the forming fluid (F) in the chamber (44), and ii) an upstream end (31*b*) that cooperates with the means (32) for operation of the piston in the linear motion, and wherein the means (32) for the operation of the piston in the linear motion comprises an upstream space (32*a*) in which the upstream end (31*b*) of the piston (31) extends, said upstream space (32*a*) containing an electrically conducting fluid (C) and being provided with means (32*c*) for generating an electrical discharge into said conducting fluid (C) that generates the primary shock wave inside the conducting fluid (C) with a pressure that acts upon the upstream end (31*b*) of the piston (31), and via the downstream end (31*a*) of the piston (31) moving in the linear motion through the application tool (4), to generate the final shock wave inside the forming fluid (F) in the chamber (44).

19. The method according to claim 18, wherein the forming fluid (F) is water.

* * * * *